US005418511A

United States Patent [19]

Theisen et al.

[11] Patent Number: 5,418,511

[45] Date of Patent: May 23, 1995

[54] D.C. ELECTROMAGNETIC CONTACTOR

[75] Inventors: Peter J. Theisen, West Bend; Randal V. Malliet, Waukesha; Frederick F. Banach; John S. Jackson, both of West Allis; Peter J. McGinnis, Brookfield, all of Wis.

[73] Assignee: Eaton Corporation, Cleveland, Ohio

[21] Appl. No.: 239,481

[22] Filed: May 9, 1994

[51] Int. Cl.[6] ..... H01H 9/30

[52] U.S. Cl. ..... 335/201; 335/16; 218/1

[58] Field of Search ..... 335/201, 16, 147, 195; 200/144 R

[56] References Cited

U.S. PATENT DOCUMENTS

| | | | |
|---|---|---|---|
| 3,511,950 | 12/1968 | Boyd | 200/144 |
| 3,516,090 | 6/1970 | Hurtle et al. | 335/16 |
| 4,019,006 | 4/1977 | Strossner | 200/144 R |
| 4,158,829 | 6/1979 | Gutberlet | 335/201 |
| 4,866,266 | 9/1989 | Hisatsune et al. | 200/144 R |
| 5,004,874 | 4/1991 | Theisen et al. | 200/144 R |
| 5,051,589 | 9/1991 | Kruglyansky | 200/148 R |

*Primary Examiner*—Lincoln Donovan
*Attorney, Agent, or Firm*—L. G. Vande Zande

[57] ABSTRACT

Molded insulating shell halves are secured together around a blowout coil, stationary and movable contacts to pivotally trap an armature assembly therebetween. Windows are provided in the shell halves to ventilate the electromagnet coil during operation. The electromagnet is removable through the window without disassembly of the contactor. Contact and armature adjustment is accomplished through additional window openings. An arc chute having left and right-hand arc extinguishing chambers each sub-divided into upper and front chambers splits the arc into four series segments and increases the overall length of the arc significantly over similar prior art devices.

11 Claims, 7 Drawing Sheets

D.C. ELECTROMAGNETIC CONTACTOR

BACKGROUND OF THE INVENTION

This invention relates to direct current switching apparatus and more particularly to direct current electromagnetic contactors. Still more particularly, the invention relates to contactors of the aforementioned type which are especially suitable for application in D.C. traction equipment for interrupting high voltages and high currents.

In D.C. switching apparatus, an electric are is generated between separating contacts. The voltage of such arc is caused to increase, thereby driving the current in the arc down in order to extinguish the arc and achieve circuit interruption. There are numerous techniques known in D.C. switching technology to extinguish arcs, such techniques often being used in various combinations. For example, lengthening the are generates a rise in are voltage. Separating the arc into a plurality of smaller segments increases its voltage and tends to cool the are. Confining the arc and compressing it to flatten the cross sectional shape thereof also increases the arc voltage. Still another technology is to subject the arc to materials which emit a quenching gas when subjected to the heat of the arc. U.S. Pat. No. 3,511,950 issued May 12, 1970 to D. R. Boyd discloses a direct current electromagnetic contactor having an are chute which utilizes the aforementioned arc interruption technologies to divide the arc into two initial segments and to move the arc segments into respective left and right-hand arc extinguishing chambers. This invention relates to improvements thereover.

SUMMARY OF THE INVENTION

D.C. switching apparatus in the form of an electromagnetically operated contactor is provided having a molded insulating housing substantially enclosing the operating mechanism of the contactor. The housing is provided with windows to permit heat from the operating coil to escape and to permit removal of the coil through a window without disassembling the contactor housing. Additional windows are provided for adjusting contact engagement at a specified armature gap from the exterior of the apparatus. The armature comprises a magnetic plate secured to a fiber resin molded lever having oppositely directed coaxial trunnions trapped in bearing openings in the molded insulating housing to provide a pivotal mounting for the lever. An improved arc chute comprises side-by-side left and right-hand arc extinguishing chambers which are each subdivided into two additional chambers oriented forwardly and upwardly, respectively. A series of arc runners and split conductors are disposed in the arc chute chambers to divide the arc into four segments.

The D.C. switching apparatus of this invention will be more fully understood and its features and advantages will become more readily apparent when reading the following description and claims in conjunction with the accompanying drawings.

DETAILED DESCRIPTION OF THE PREFERRED EMBODIMENT

Figure 2:
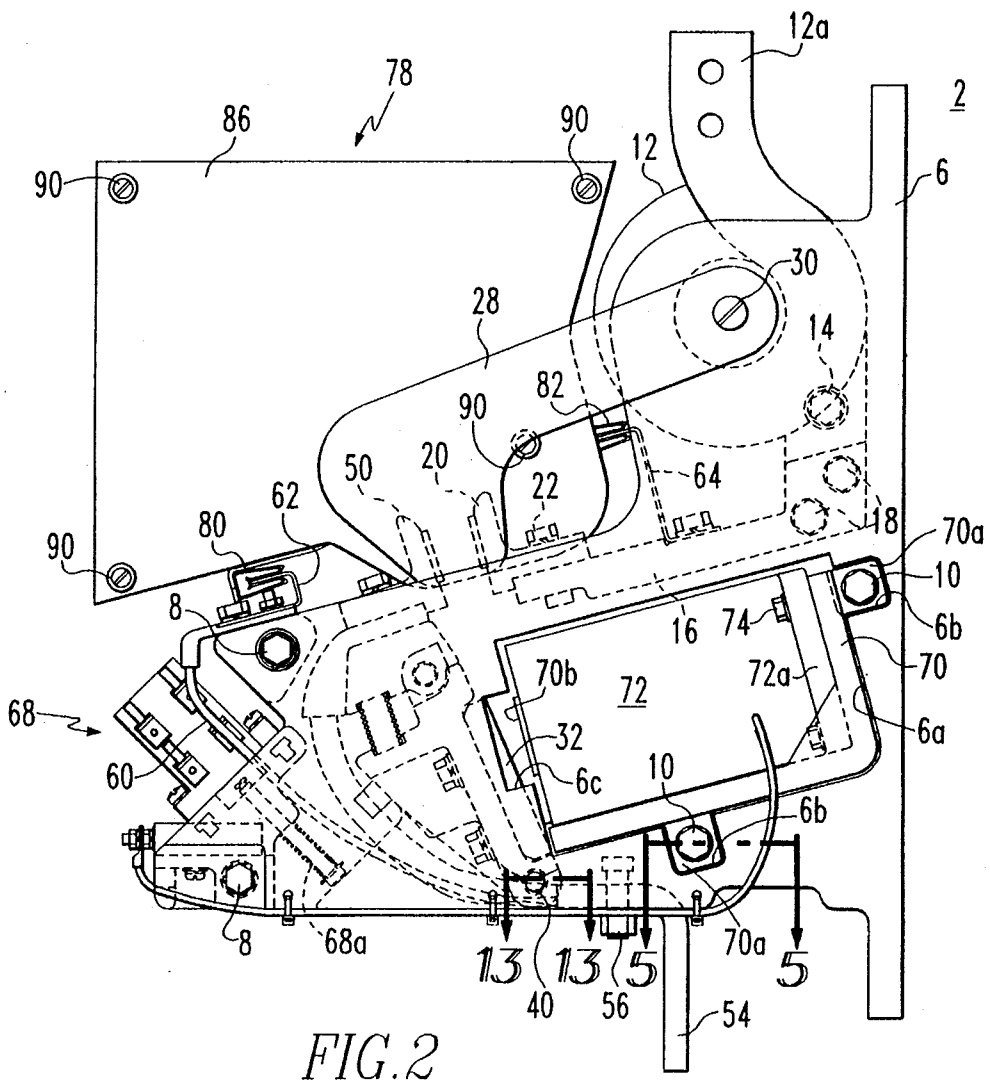
FIG. 2 is a right elevation view of the D.C. switching apparatus of FIG. 1.
Figure 6:
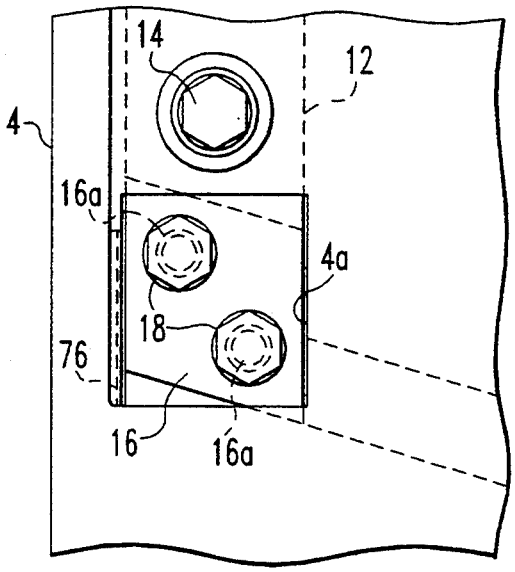
FIG. 6 is a fragmentary elevation view taken in the direction of arrows 6—6 in FIG. 1.

The direct current electromagnetically operated switching apparatus 2 of this invention has a molded insulating housing comprising a pair of mating insulating shell halves 4 and 6 which abut each other along particular segments. The switching apparatus, more commonly known as an electromagnetically operated contactor, is particularly adapted to have the various components assembled to the left-hand shell half 4, the right-hand shell half 6 subsequently positioned over the assembled components and the two shell halves secured together by respective fasteners such as bolts 8 and 10. A spiral-wound blowout coil 12 is attached to the inside of left-hand shell half 4 by a bolt 14 which extends through a hole (not shown) in the left-hand shell half 4 and takes into an aligned threaded hole in blowout coil 12. A right-hand end 12*a* of blowout coil 12 projects upwardly as one terminal of the contactor. A stationary contact bar 16 is secured to the left-hand end of blowout coil 12 by a pair of screws 18 which are accessible through a window 4a in left-hand shell half 4 as seen in FIG. 6. Stationary contact bar 16 extends forwardly at a downward angle and has a stationary contact 20 attached to the distal end thereof by a screw 22 extending through a clearance hole in stationary contact 20 and taking into a threaded hole in stationary contact bar 16. A left-hand pole piece 24 is secured to a cylindrical core 26 which extends through a hole in the shell half 4 and through the center of blowout coil 12. Pole piece 24 has the same profile as right-hand pole piece 28 (seen in FIG. 2) which is attached to the right-hand end of core 26 by a screw 30 after right-hand shell half 6 is positioned to the contactor assembly.

Figure 3:
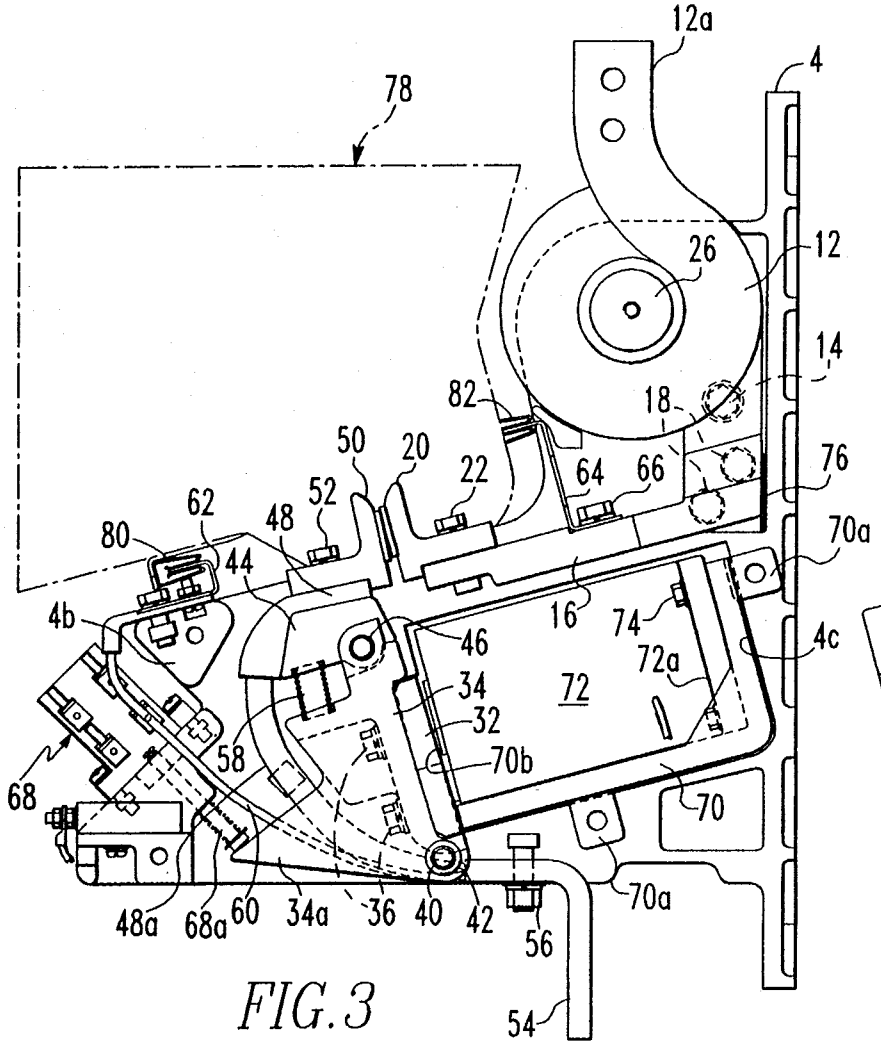
FIG. 3 is a view similar to FIG. 2 but having a right-hand housing half removed to disclose internal components of the apparatus.
Figure 13:
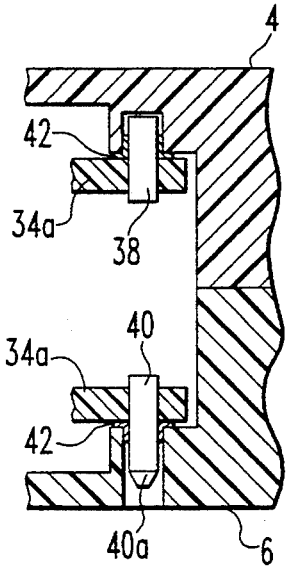
FIG. 13 is a fragmentary section view taken along line 13—13 in FIG. 2.

An armature assembly carrying a movable contact assembly thereon is pivotally mounted in the molded insulating housing of the contactor 2. The armature assembly comprises a magnetic plate 32 attached to the face of a molded fiber resin lever 34 by screws 36. Lever 34 has a pair of depending sides 34a which define a channel therebetween through which electrical conductors extend. A pivot pin 38 is molded into the left-hand leg 34a of lever 34 (FIG. 13) and a similar pivot pin 40, but having a truncated end 40a, is molded into the right-hand leg 34a of lever 34 to provide a pair of oppositely directed coaxial trunnions for lever 34. Flanged cylindrical bushings 42 are disposed over the pivot pins 38 and 40 to fit within corresponding openings in the housing shell halves 4 and 6. A pair of movable contact support posts 44 are pivotally supported between the sides of lever 34 at the upper end thereof by a pivot pin 46. Each of the support posts 44 receives a crimped wire connector 48 and a movable contact 50 secured thereto by a screw 52 (FIG. 3). Each crimped connector 48 has a braided conductor 48a attached thereto and both of the conductors 48a are commonly affixed to the other terminal 54 of the contactor. Terminal 54 is secured to the housing by screws 56. Helical springs 58 disposed between a shelf portion of lever 34 and the under side of the respective movable contact support posts 44 impart a clockwise bias to the movable contacts as viewed in FIG. 3. An insulated wire conductor 60 is also attached to terminal 54 and extends forwardly between legs 34a of lever 34 to be connected to a front stab bracket 62 mounted to a forward cross member 4b of left-hand housing shell half 4. A rear stab bracket 64 is attached to stationary contact arm 16 by a screw 66.

Figure 1:
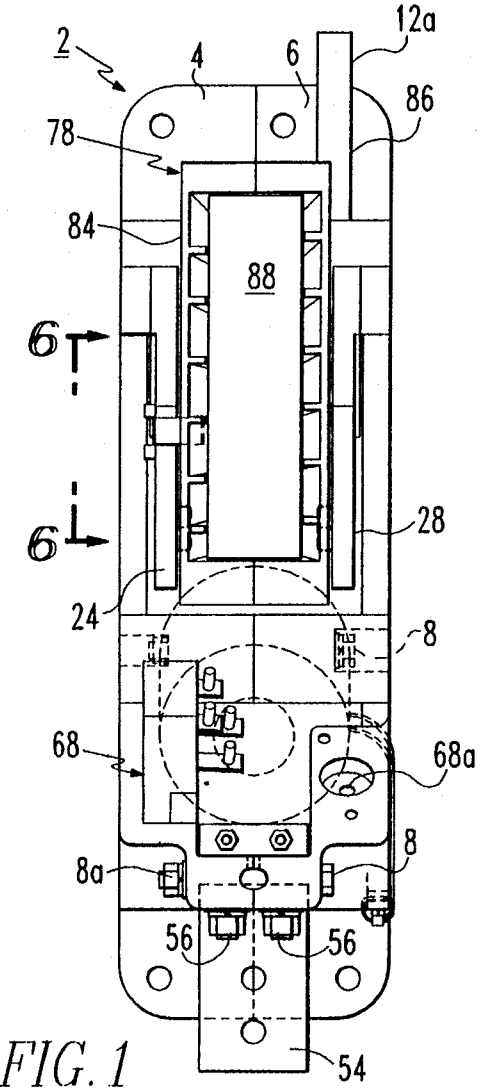
FIG. 1 is a front elevation view of the D.C. switching apparatus of this invention.

One or two interlock switches such as 68 may be mounted on the front of the molded insulating housing for the contactor 2 as desired. Only one is shown, that being mounted to the left-hand housing half 4 by appropriate screws. A spring biased plunger 68a extends through an opening in the housing half to bear against a depending side leg 34a of lever 34 for actuation of the switch 68. Right-hand housing shell half 6 is positioned over the assembled components and secured to the left-hand housing shell half 4 by bolts 8 which threadably engage with nuts 8a as seen in FIG. 1. Right-hand pole piece 28 is positioned against right-hand housing shell half 6 and attached to the core 26 by screw 30.

Figure 4:
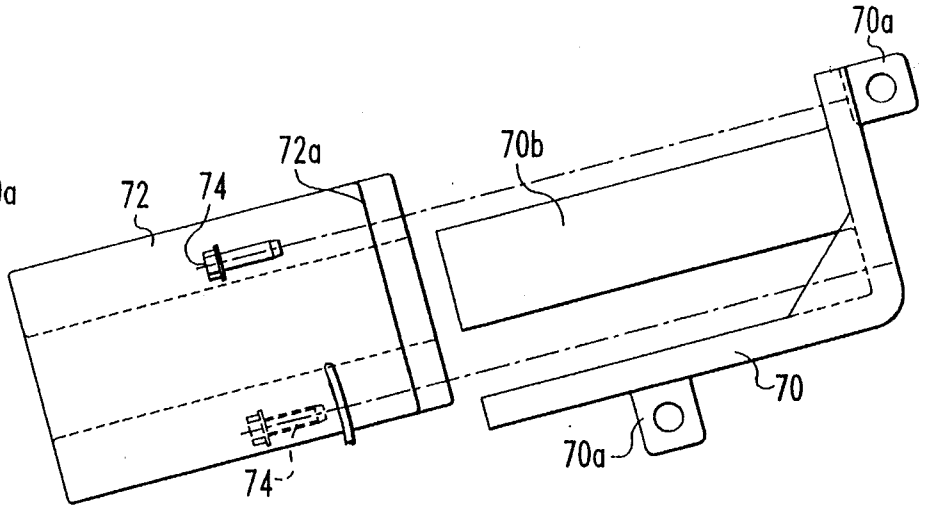
FIG. 4 is an exploded elevation view of the electromagnet of the D.C. switching apparatus of this invention.
Figure 5:
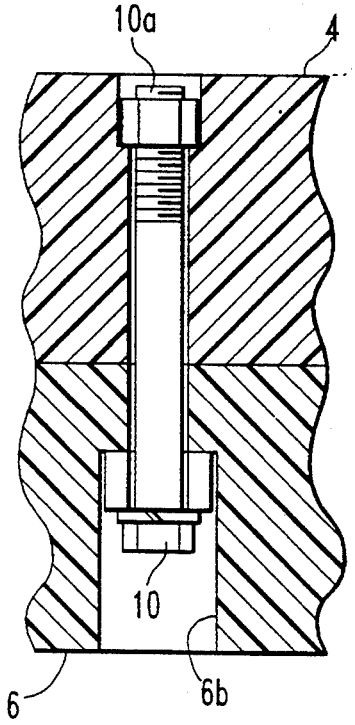
FIG. 5 is a partial section view taken along line 5—5 in FIG. 2.

Left-hand housing shell half 4 has a rectangular window 4c disposed obliquely relative to the back plane of the housing. Right-hand housing shell half 6 has a corresponding window 6a aligned with window 4c when the two shell halves are assembled together. Rectangular recessed pockets 6b are provided adjacent window 6a to receive mounting tabs 70a of an L-shaped magnetic frame 70 shown separately in FIG. 4. Magnet frame 70 has a cylindrical core 70b affixed to the upright leg thereof. A coil 72 is disposed over the core 70b and affixed to the frame 70 by a pair of screws 74 which extend through openings (not shown) in a flange 72a of coil 72 and take into appropriate threaded openings (not shown) in the upright leg of frame 70. The assembled coil 72 and magnet frame 70 provide an electromagnet assembly for the contactor 2 which may be installed or removed through the window 6a without disassembling the contactor housing. Tabs 70a rest upon the bottom of the recesses 6b to laterally position the electromagnet assembly within the contactor housing. Bolts 10 extend through openings in the tabs 70a and in the housing shell halves 6 and 4 and threadably engage nuts 10a (FIG. 5) disposed within hexagonal molded pockets in housing shell half 4 to secure the electromagnet assembly in place and to further secure the two housing shell halves 4 and 6 together. The windows 4c and 6a also provide for ambient cooling of coil 72.

Contact adjustment for contactor 2 is facilitated by window 4a, the provision of a rectangular notch 6c in the forward edge of window 6a and a similar notch in the forward edge of window 4c. Holes 16a in stationary contact support arm 16 are made particularly oversize to permit movement of the contact support arm 16 relative to the screws 18 prior to tightening the screws. To adjust the contacts, the armature assembly is manually pivoted against a gauge which may be inserted within the notch 6c and positioned against the face of core 70b to effect a desired armature gap at initial engagement of the contacts 20 and 50. Shims 76 are positioned within the window 4a against the back wall of housing shell half 4 to establish the proper longitudinal position of the stationary contact support arm 16 and the stationary contact 20 such that initial engagement of the contacts as shown in FIG. 3 occurs at the desired armature gap. Bolts 18 are then tightened to firmly clamp the stationary contact assembly in place. Full face engagement of movable contact 50 to stationary contact 20 occurs upon sealing of the armature 32 to the pole face of core 70b, whereby movable contact supports 44 are pivoted about pin 46 against the bias of spring 58 to permit flush engagement of the contact faces.

An arc chute assembly 78 is attached to the assembled contactor 2 by sliding the arc chute assembly between the pole pieces 24 and 28 and engaging spring clip connectors 80 and 82 with the connector stab blades 62 and 64, respectively. Arc chute assembly 78 comprises a left-hand housing element 84, a right-hand housing element 86 and a center plate 88 secured together by four screws 90 which extend through holes in the housing members 84 and 86 from the right-hand side 86 to take into nuts (not shown) trapped in hexagonal pockets in the left-hand member 84.

Figure 7:
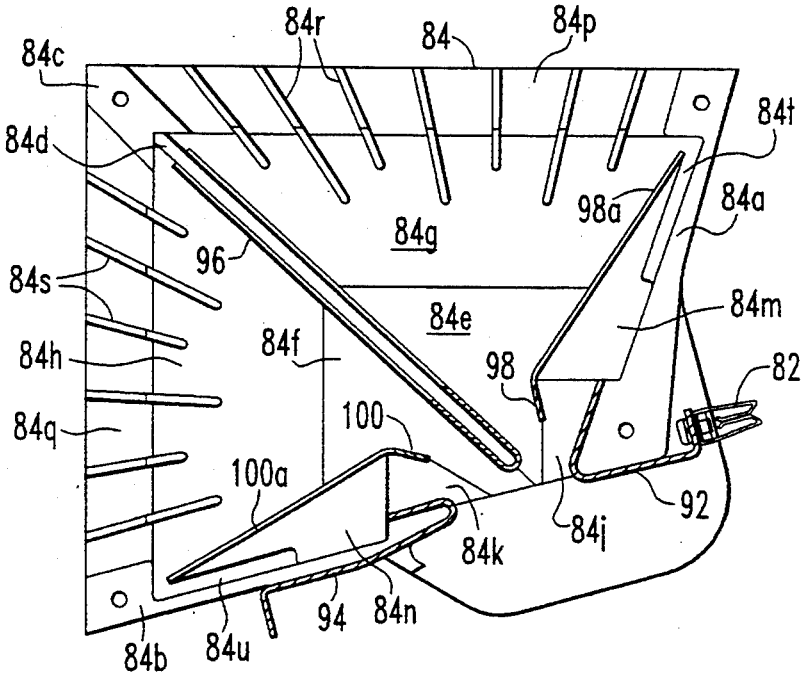
FIG. 7 is a view of a left-hand housing member of an arc chute of the D.C. switching apparatus of this invention with conductive arc runners positioned therein.

Referring more particularly to FIGS. 7–12 and 14, the arc chute assembly 78 provides left-hand and right-hand arcing chambers which each are subdivided into forward and upper arcing chambers thereby providing four distinct chambers for extinguishing the arc. The inside face of left-hand arc chute housing member 84 is shown in FIG. 7. Housing member 84 has a rear wall 84a, a lower wall 84b and a boss 84c at the forward upper corner of the housing member, each of which provide a mating surface for corresponding elements of the right-hand housing member 86. Conductive arc runners 92 and 94 are positioned in housing member 84 by the walls 84a and 84b, respectively. The arc runners 92 and 94 extend transversely across both the left-hand and right-hand arcing chambers and therefore the portions of each which are disposed in the left-hand arcing chamber are shown in FIG. 7, crosshatched to indicate that the portions disposed in the right-hand arcing chamber have been broken away. Spring clip 82 is secured to an upright flange of arc runner 92 as seen in FIG. 7. However, spring clip 80 is attached to the right-hand portion of arc runner 94 and therefore does not appear in FIG. 7.

The opening or throat of the arc chute is defined between the arc runners 92 and 94 and extends across both the left and right-hand chambers. A positioning rib 84*d* extends from the opening angularly forward and upward to the boss 84*c* to position a hairpin conductor 96. Conductor 96 is an elongated U-shaped member, the legs of which extend on either side of rib 84*d* and the closed end of which extends laterally into both left-hand and right-hand chambers. The closed bight portion of hairpin conductor 96 is disposed essentially centrally of the opening formed between arc runners 92 and 94 and is disposed slightly inwardly of the arc chamber. A pair of V-shaped conductors 98 and 100 have laterally offset divergent legs which are disposed in the left-hand and right-hand arc extinguishing chambers. With particular reference to FIG. 7, the base of conductor 98 extends between both left-hand and right-hand arc extinguishing chambers and is therefore cross sectioned to illustrate that the portion disposed in the right-hand chamber has been broken away. A leg 98*a* extends obliquely along the rear leg 84*a* of housing member 84, terminating near the upper rear corner of the housing member 84. A leg 100*a* of conductor 100 similarly extends obliquely along lower wall 84*b* of housing 84, terminating near the lower front corner of the housing 84.

The inside surface of left-hand housing member 84 comprises a first pair of inclines 84*e* and 84*f* leading to the major interior surfaces 84*g* and 84*h*, which surfaces are coplanar. A second pair of inclines 84*j* and 84*k* rise at a steeper angle than inclines 84*e* and 84*f* and terminate at a height coincident with the right-hand surface of a center plate 88 positioned on housing member 84 as will be described hereinafter. Second level surfaces 84*m* and 84*n* are raised above the respective adjacent surfaces 84*g* and 84*h*. Surface 84*m* is disposed between rear wall 84*a* and leg 98*a* of V-shaped conductor 98 and surface 84*n* is located between lower wall 84*b* and the leg 100*a* of V-shaped conductor 100. An outwardly beveled surface 84*p* is provided along the upper edge of surface 84*g* and an outwardly beveled surface 84*q* is provided along the forward edge of surface 84*h*. A plurality of ribs 84*r* are provided on the surfaces 84*g* and 84*p*, the ribs being oriented radially from the mouth of the arc chute assembly, particularly the area between arc runner leg 98*a* and hairpin conductor 96. Similarly, a plurality of ribs 84*s* extend along the forward surfaces 84*h* and 84*q*, the ribs 84*s*also being oriented radially relative to the mouth of the arc chute assembly, particularly the area between hairpin arc runner 96 and conductor 100*a*.

Figure 8:
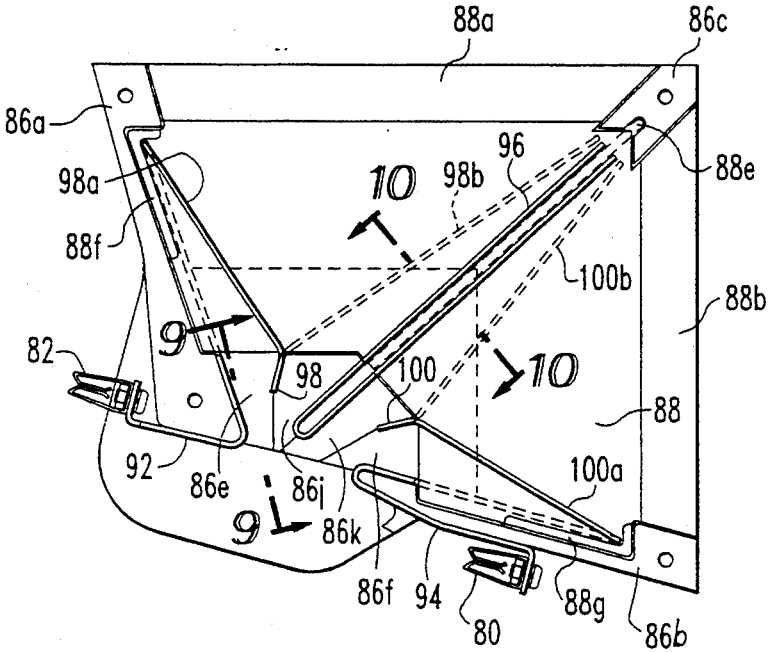
FIG. 8 is a view of a right-hand housing member of the arc chute having a center insulator and the conductive arc runners positioned thereto, FIGS. 7 and 8 conjunctively illustrating a left-hand arc extinguishing chamber of the arc chute.
Figure 9:
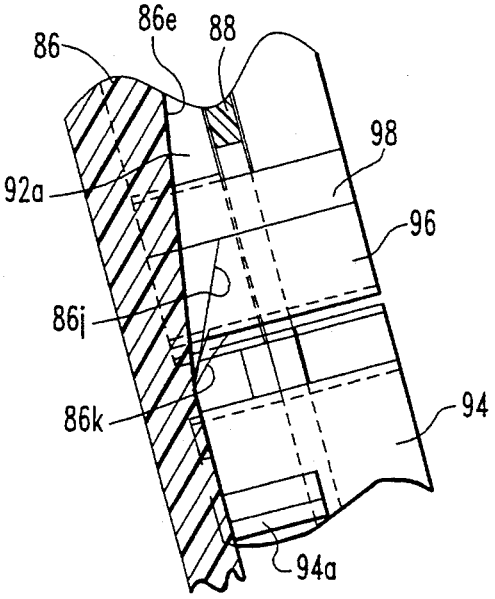
FIG. 9 is a partial section view taken along line 9—9 in FIG. 8.
Figure 10:
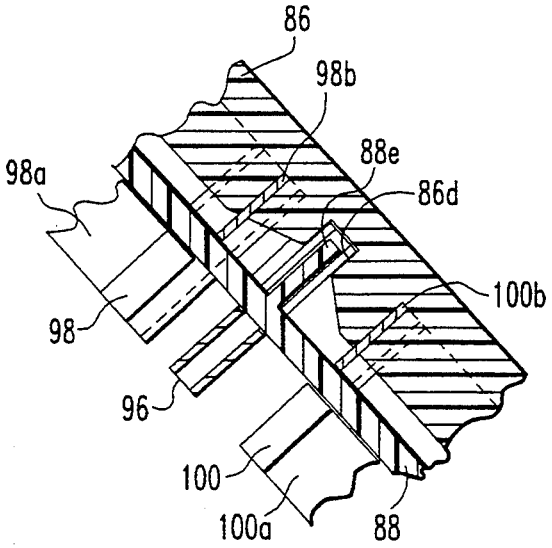
FIG. 10 is a partial section view taken along line 10—10 in FIG. 8.

A center plate 88 is disposed upon the inner surface of left-hand arc chute housing member 84, the center plate resting on surfaces 84*m* and 84*n* as well as on the surface of positioning rib 84*d* and ribs 84*r* and 84*s*. Center plate 88 is essentially a planar member having double-beveled upper and forward outer edges to provide an outward flaring at the upper and forward outer edges. The angle of the bevel of the flared outer portions is substantially parallel to the angle of the beveled portions 84*p* and 84*q* to provide outwardly directed passageways for arc gasses to exit the arc chute as seen particularly in FIG. 14. Referring particularly to FIG. 8, center plate 88 is illustrated as it is seen from within the left-hand arc extinguishing chamber looking toward the right-hand housing member 86. Outwardly flared upper beveled portion 88*a* extends along the upper edge of the arc chute assembly and outwardly flared forward beveled portion 88*b* extends along the forward edge. As can be seen, the extended legs of hairpin conductor 96 and the leg 98*a* of conductor 98 and 100*a* of conductor 100 are disposed within the left-hand chamber against the surface of center insulator plate 88.

Figure 11:
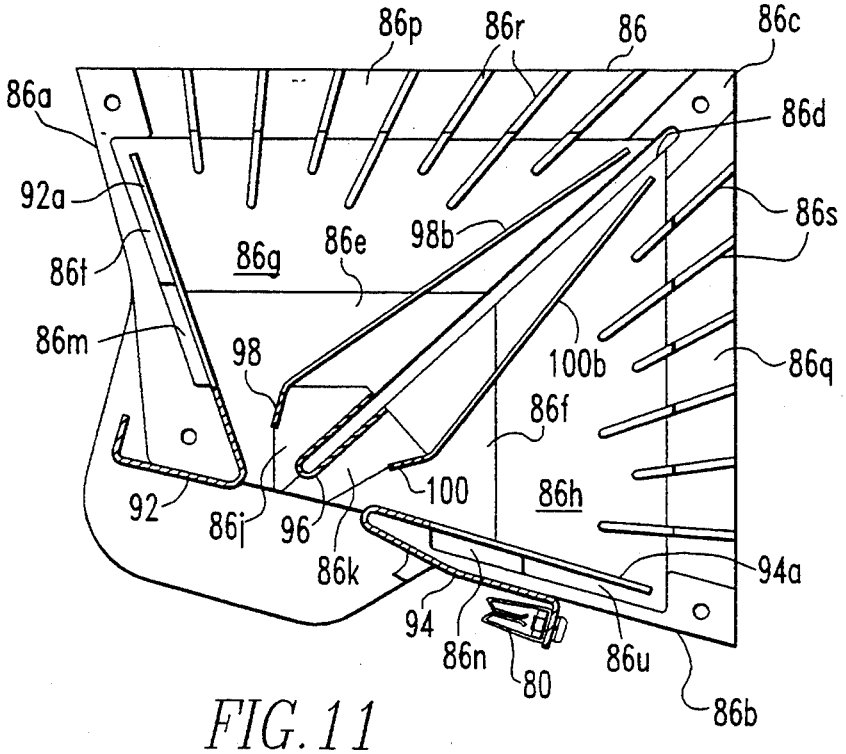
FIG. 11 is a view of the right-hand insulating housing member of the arc chute similar to FIG. 8, but having the center insulator removed therefrom and illustrating only the portions of the conductive arc runners that are disposed within the right-hand arc extinguishing chamber.
Figure 12:
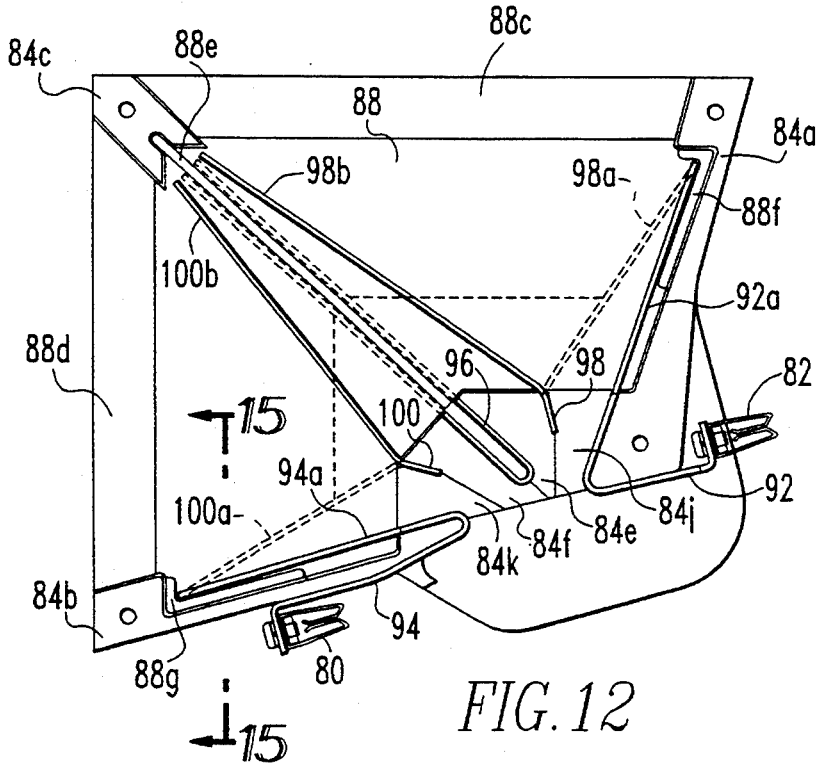
FIG. 12 is a view of the left-hand insulating housing element of the arc chute having the center insulator positioned therein and showing the conductive arc runner members disposed therein, FIGS. 11 and 12 conjunctively illustrating the right-hand chamber of the arc chute of this invention.
Figure 14:
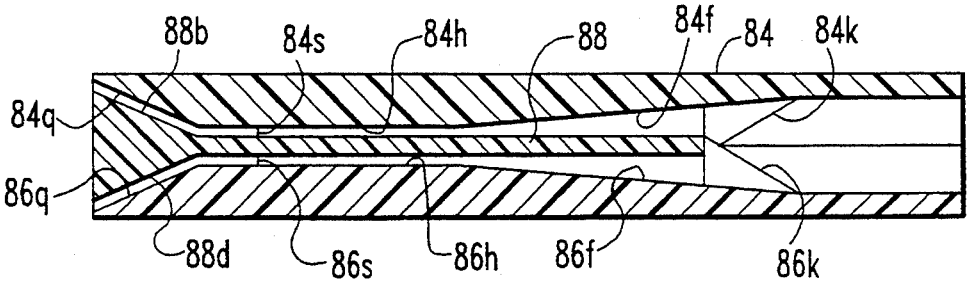
FIG. 14 is a schematic cross sectional depiction of the arc chute of this invention.

The right-hand surface of center plate 88 is provided with beveled surfaces 88*c* and 88*d* which extend outwardly in the opposite direction to the surfaces 88*a* and 88*b*, respectively, to provide the flared outer edges as seen in FIG. 12. The right-hand surface of plate 88 is also provided with a raised rib 88*e* which extends angularly upwardly and outwardly parallel to the hairpin conductor 96. The right-hand surface of center plate 88 is disposed in mating relationship with the inside surface of right-hand housing member 86 which is shown in FIG. 11. Housing member 86 has a rear wall 86*a*, a bottom wall 86*b* and a boss 86*c* located at the outer, upper corner thereof, each defining surfaces which are coplanar and which mutually engage the corresponding surfaces of left-hand housing member 84. Arc runner 92 is disposed also within right-hand arc chute housing member 86, the arc runner having a leg 92*a* which extends upwardly along the rear wall 86*a*. Arc runner 94 is positioned also within the right-hand arc chute housing member 86 and has a leg 94*a* which extends along the lower wall 86*b*. The U-shaped portion of hairpin arc runner 96 is common to both the left and right-hand housing members 84 and 86 and is shown in FIG. 11. The other leg 98*b* of V-shaped conductor 98 is shown in FIG. 11 and is disposed within the right-hand arc chamber extending angularly outwardly toward the boss 86*c*. Similarly, the other leg 100*b* of V-shaped conductive member 100 extends angularly outwardly toward the boss 86*c*. An elongated slot 86*d* is provided in the interior surface of right-hand housing member 86 parallel with the disposition of hairpin arc runner 96. The inside surface of right-hand arc chute housing member 86 has a pair of inclines 86*e* and 86*f* which lead from the throat of the arc chute to the major coplanar surfaces 86*g* and 86*h* of the member 86. Slots are provided in the surfaces 86*e* and 86*g* to receive and position the leg 98*b* of V-shaped conductor 98 as are slots in the surfaces 86*f* and 86*h* to receive the leg 100*b* of V-shaped conductor 100. A pair of inclines 86*j* and 86*k* extend along the lower end of hairpin conductor 96 to a height that will be even with the left-hand surface of center plate 88 in the left-hand arc chamber as seen in FIG. 14 when the arc chute assembly is fully assembled. Similarly to member 84, the outer edge along surface 86*g* has an outwardly flared bevel 86*p* and the outer edge along surface 86*h* has an outwardly flared portion 86*q*. A plurality of ribs 86*r* are formed on the surfaces 86*g* and 86*p*, the ribs being oriented substantially radially from the mouth of the arc extinguishing chamber, particularly the area between legs 92*a* of arc runner 92 and 98*b* of V-shaped conductor 98. A plurality of ribs 86*s* are formed on the surfaces 86*h* and 86*q*, the ribs 86*s* being oriented radially from the area between leg 94*a* of arc runner 94 and leg 100*b* of V-shaped conductor 100. A stepped surface 86*m* is provided in rear wall 86*a* behind leg 92*a* of arc runner 92. Likewise, a stepped surface 86*n* is provided in lower leg 86*b* behind leg 94*a* of arc runner 94. The surfaces 86*m* and 86*n* and ribs 86*r* and 86*s* provide mounting surfaces against which the center plate 88 rests. When center plate 88 is positioned against the right-hand housing half 86, rib 88*e* extends into slot 86*d* as seen best in FIG. 10 to provide additional over surface spacing between the conductors 98*b* and 100*b*, particularly at the converging ends near boss 86*c*.

Figure 15:
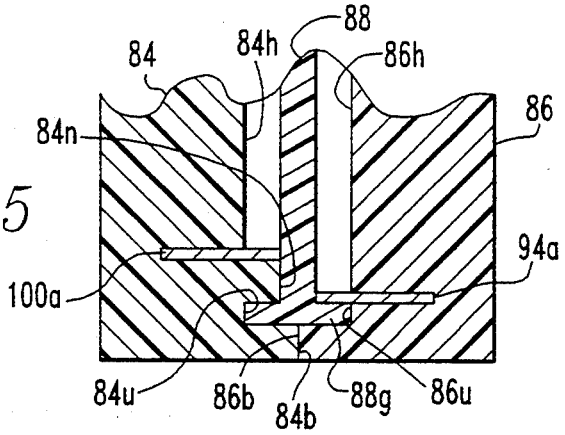
FIG. 15 Is a partial section view taken along line 15—15 in FIG. 12.

The outer ends of surfaces 84*m* and 84*n* of housing member 84 are relieved as seen in FIG. 7 to cooperatively define with walls 84*a* and 84*b*, respectively, recesses 84*t* and 84*u*, respectively. The bottom of recesses 84*t* and 84*u* are at the same level as the surfaces 84*g* and 84*h* as can be seen in FIG. 15. Similarly, housing member 86 has recessed areas 86*t* and 86*u* immediately outward of raised surfaces 86*m* and 86*n*, respectively, and adjacent the outer ends of walls 86*a* and 86*b* respectively. The bottom of recessed areas 86*t* and 86*u* are at the same level as surfaces 86*g* and 86*h*, respectively, as seen in FIG. 15. Center plate 88 has L-shaped ribs 88*f* and 88*g* projecting from opposite surfaces thereof at the upper and forward corners thereof to interfit with the respective recesses 84*t*, 84*u*, 86*t*, and 86*u* as seen in FIG. 15, thereby increase over surface distance along the insulating members between conductors of opposite potential.

FIG. 12 illustrates the right-hand arc extinguishing chamber as viewed from inside looking at the center plate 88. With the elements so assembled and held together by the screws 90, a left-hand arc extinguishing chamber is formed between left-hand arc chute housing member 84 and center plate 88 and a right-hand arc extinguishing chamber is formed between right-hand arc chute housing member 86 and the center plate 88. Left-hand arc extinguishing chamber is subdivided into a separate forwardly directed arc extinguishing chamber extending between hairpin arc runner 96 and leg 100*a* of V-shaped conductor 100 and an upwardly directed arc extinguishing chamber extending between hairpin arc runner 96 and leg 98*a* of V-shaped conductor 98. The right-hand arc extinguishing chamber is subdivided into a forwardly facing arc extinguishing chamber extending between arc runner leg 94*a* and leg 100*b* of V-shaped conductor 100 and a second upwardly directed arc extinguishing chamber extending between leg 92*a* of arc runner 92 and leg 98*b* of V-shaped conductor 98.

An arc generated between contacts 20 and 50 upon separation thereof is moved into the throat of the arc chute by a magnetic field generated by coil 12 and transfers to the arc runners 92 and 94. Further movement into the arc chute causes the arc to split into a first segment between arc runner 92 and hairpin arc runner 96 and a second segment between hairpin arc runner 96 and arc runner 94. Further movement of the arc under the influence of the coil 12 and pole pieces 24 and 28 moves the arc along the various inclines 84*e*, 84*f*, 84*j*, 84*k* and 86*e*, 86*f*, 86*j* and 86*k* to the bases of V-shaped conductors 98 and 100, whereupon each segment of the arc again splits in half. One of the newly formed segments of the arc moves into the upper right-hand arc extinguishing chamber and extends between the divergent legs 92*a* and 98*b*. The other newly formed segment moves into the left-hand arc extinguishing chamber and extends between leg 98*a* and one leg of hairpin arc runner 96. Similarly, the other arc segment divides in two and one segment thereof moves into the forward portion of the right-hand arc extinguishing chamber extending between the divergent legs 94*a* and 100*b*. The other segment moves into the left-hand arc extinguishing chamber and extends between hairpin arc runner 96 and divergent leg 100*a* of V-shaped conductor 100.

One of the techniques for raising the voltage of an arc and thus extinguishing an arc is to lengthen the arc. The arc initially formed between contacts 20 and 50 is doubled in length by the series arc segments that extend between arc runner leg 92*a* and V-shaped conductor leg 98*b* which is common with conductor leg 98*a*, thereby establishing another arc segment between leg 98*a* and hairpin arc runner 96. A third segment of the original arc extends from hairpin arc runner 96 to leg 100*a* of V-shaped conductor 100 which is common with leg 100*b* in the right-hand arc chamber and a fourth arc established between leg 100*b* and leg 94*a* of arc runner 94. The arc is also lengthened as it moves outwardly along the respective divergent conductive arc runners. As mentioned hereinabove, this length is doubled as the arc moves in both the left-hand and right-hand arc extinguishing chambers, yet the length of the four individual segments is shortened. As the arc moves along the diverging conductive members, it moves along the inclines 84*e* and 84*f* and 86*e* and 86*f* which converge with the center plate 88 as seen in FIG. 14 to constrict the arc. As the arc moves into the flattened area of 84*g*, 84*h*, 86*g*, and 86*h*, the arc is constricted and flattened which also operates to raise the arc voltage. The center plate 88 is made from a material that reacts with the heat of the arc when in contact therewith to emit arc quenching gasses. A preferred material is a glass-filled thermoset polyester containing hydrated alumina. Thus the arc is flattened, constricted and subjected to quenching gasses in the areas 84*g*, 84*h*, 86*g* and 86*h*. Subsequent outward movement of the arc moves it into the insulating ribs 84*r*, 84*s*, 86*r* and 86*s*. When the arc loses sufficient energy, the diameter of the arc reduces resulting in reduced constriction. The lower energy level of the smaller arc permits the arc to bend around the ribs, thereby again increasing in length and compensating for the reduction in constriction. The ribs prevent the arc per se from exiting the arc chute assembly while arc gasses, on the other hand, do exit the upward and forward sides of the arc chute assembly.

Figure 16:
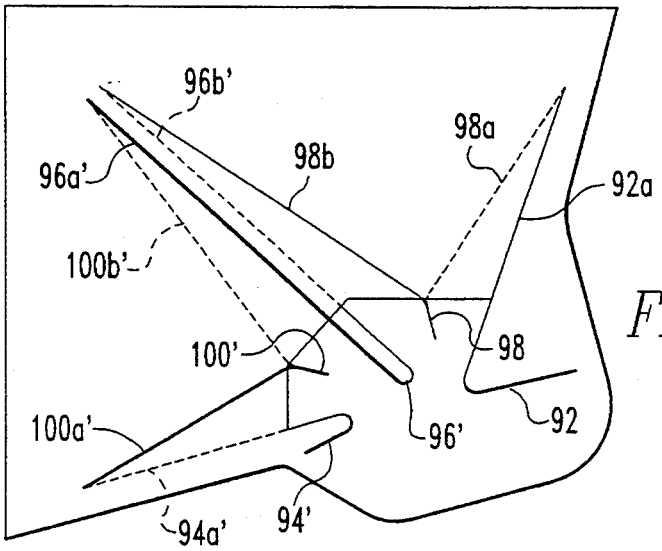
FIG. 16 is a schematic elevation view of another embodiment of the arc chute of this invention.

FIG. 16 schematically depicts an alternate embodiment of the four-chamber arc chute described hereinabove. In this embodiment, the hairpin arc runner 96' has the legs offset from each other whereby one leg 96*a'* is in the right-hand arc extinguishing chamber and the other leg 96*b'* is in the left-hand arc extinguishing chamber. Arc runner leg 94*a'* is disposed in the left-hand chamber as is the leg 100*b'* of V-shaped conductor 100. The leg 100*a'* of the conductor is disposed in the right-hand chamber. Arc runner 92 and V-shaped conductor 98 are the same as in the above described version. An arc formed between contacts 20 and 50 is moved into the arc chute and separated into four segments as before, but the segments are located in a different serial relationship in the four sub-chambers. The arc extends from arc runner leg 92*a* to conductor leg 98*b* in the right-hand upper sub-chamber which leg 98*b* is common with leg 98*a*. A second segment of the arc extends from leg 98*a* to hairpin conductor leg 96*b* in the left-hand upper sub-chamber, which leg 96*b'* is common with leg 96*a'* thereof. The third segment of the arc occurs in the right-hand front sub-chamber between hairpin conductor leg 96*a'* and V-shaped conductor leg 100*a'*, which is common with leg 100*b'*. The fourth segment of the arc occurs in the left-hand front sub-chamber between leg 100*b'* and arc runner leg 94*a'*. This embodiment permits the arc runner legs 92*a* and 94*a'* to be located in different left and right arc extinguishing chambers. In this embodiment, it is preferable to provide an insulating rib-like rib 88*e* on both surfaces of the center plate and an appropriate groove such as 86*d* in the other housing half 84 to provide adequate over-surface distance between the conductors of different potential.

Figure 17:
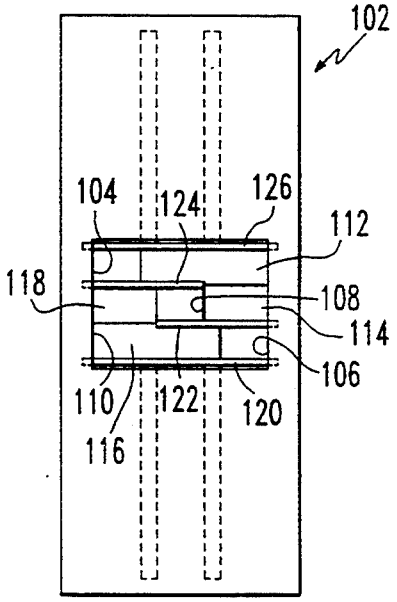
FIG. 17 is a schematic end view of yet another embodiment of the arc chute of this invention.
Figure 18:
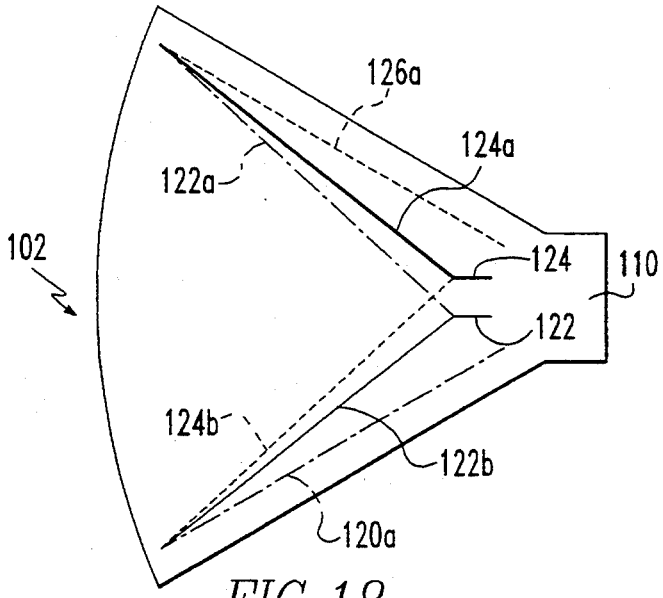
FIG. 18 is a schematic elevation view of the embodiment of FIG. 17.

Another embodiment of the arc chute of this invention is depicted schematically in FIGS. 17 and 18. This arc chute 102 comprises three arc chambers, two outer chambers 104 and 106 and a center chamber 108. FIG. 17 is a view looking at the bottom of the arc chute into the inlet opening 110. Inclines 112 and 114 in one housing part direct the arc segments into outer chamber 104 and center chamber 108, respectively, while inclines 116 and 118 in the other housing part direct arc segments into outer chamber 106 and center chamber 108, respectively. A first arc runner 120 is connected to one of the device contacts and extends across all three chambers within the inlet opening 110. However, the leg 120*a* of arc runner 120 extends along within one of the outer chambers, e.g. 106, as represented by the dot-dash line in FIG. 18. A first V-shaped conductor 122 is located between chambers 106 and 108 in the inlet opening 110. A first leg 122*a* is disposed within the outer chamber 106 as depicted by the dot-dash line in FIG. 18, while a second leg 122*b* is disposed in the center chamber 108 at the left-hand side thereof, substantially parallel with the leg 120*a*.

A second V-shaped conductor 124 is located between chambers 108 and 104 in the inlet opening 110. A first leg 124*a* is disposed in the outer chamber 108 substantially parallel with leg 122*a*. A second leg 124*b* of conductor 124 is disposed in outer chamber 104 along the left-hand side substantially parallel with legs 120*a* and 122*b*. A second arc runner is connected to the other of the device contacts and extends through the inlet opening 110, a leg 126*a* thereof extending within the outer chamber 104 substantially parallel with the legs 122*a* and 124*a*.

In the arc chute of FIGS. 17 and 18, an arc generated between the contacts of the switching apparatus will be moved into the arc chute through the inlet opening 110. The arc will separate into three segments at the three different levels of the arc chute, thereby generally tripling its length. One segment of the arc will be disposed in chamber 104 between arc runner leg 126*a* and conductor leg 124*b*. A second segment of the arc will be in the center chamber 108 between the legs 124*a* and 122*b* of the two V-shaped conductors 122 and 124. The third arc segment will be in outer chamber 106 between conductor leg 122*a* and arc runner leg 120*a*.

The D.C. electromagnetic contactor described hereinabove provides a readily assembled and adjusted device having an improved arc chute assembly for more effectively extinguishing a high voltage arc generated between separating contacts of the contactor. It is to be understood that the described embodiment is susceptible of various modifications without departing from the scope of the appended claims.

We claim:

1. Direct current switching apparatus comprising:

an insulating base;

an electromagnet mounted to said base;

armature means movably mounted on said base, said armature means being attracted to said electromagnet upon energization of said electromagnet;

stationary contact means mounted to said base;

movable contact means mounted to said armature means, said movable contact means engaging said stationary contact means upon attraction of said armature means to said electromagnet and separating from said stationary contact means upon de-energization of said electromagnet; and an arc chute disposed adjacent said contact means, said arc chute comprising:

an insulating housing comprising a right-hand and a left-hand arc extinguishing chamber;

an inlet opening in said housing adjacent said contact means, said inlet opening being common to both said chambers;

a pair of conductive arc runners connected to said stationary contact means and said movable contact means, respectively, said arc runners extending through said inlet opening into said right-hand chamber and along walls contiguous with said inlet opening within said right-hand chamber;

an insulating barrier dividing said right-hand chamber into forward and upper sub-chambers;

an elongated U-shaped conductor dividing said left-hand chamber into forward and upper sub-chambers;

a first V-shaped conductor having one leg extending into said right-hand chamber substantially along said insulating barrier and divergent with one of said pair of arc runners toward an upper edge of said housing, said first V-shaped conductor having another leg extending into said left-hand chamber and being disposed divergent with said U-shaped conductor toward said upper edge of said housing; and a second V-shaped conductor having one leg extending into said right-hand chamber substantially along said insulating barrier and divergent with another of said pair of arc runners toward a forward edge of said housing, said second V-shaped conductor having another leg extending into said left-hand chamber and being disposed divergent with said U-shaped conductor toward said forward edge of said housing.

2. The direct current switching apparatus defined in claim 1 wherein said arc chute housing comprises a plurality of vent openings through said upper and forward edges, said vent openings communicating with respective said arc extinguishing chambers.

3. The direct current switching apparatus defined in claim 2 wherein said plurality of vent openings are defined by a plurality of internal ribs arranged along respective said upper and forward edges and extending into respective said chambers in a substantially radial arrangement emanating from said inlet opening.

4. The direct current switching apparatus defined in claim 3 wherein interior sidewalls of said insulating housings comprise inwardly tapered surfaces from said inlet opening toward said forward and upper edges, thereby defining constrictive chambers having reduced cross-sectional depth and increased sidewall surface area at increasing distances from said inlet opening.

5. The direct current switching apparatus defined in claim 1 wherein said insulating housing comprises a right-hand molded insulating housing, a left-hand molded insulating housing, and a center insulator, said right-hand and left-hand molded insulating housing being secured together around said center insulator, recesses in said walls at ends thereof remote from said inlet opening, and ribs projecting from opposite sides of said center insulator received in corresponding said recesses.

6. The direct current switching apparatus defined in claim 1 wherein said insulating base comprises a window open to a side thereof, and said electromagnet is mounted to said base within said window and accessible through said window for removal from said base through said window.

7. The direct current switching apparatus defined in claim 1 wherein said electromagnet comprises a core face against which said armature means is attracted, and said stationary contact means is linearly adjustable in a direction substantially parallel to movement of said armature means at said core face.

8. The direct current switching apparatus defined in claim 1 wherein said insulating base comprises a pair of mating insulating moldings and said armature means comprises an insulating lever having axially aligned trunnions projecting in opposite directions, said moldings having bearing holes receiving said trunnions, and fastener means securing said moldings together, retaining said trunnions engaged in said bearing holes, thereby pivotally mounting said armature means to said insulating base.

9. Direct current switching apparatus comprising:

an insulating base;

an electromagnet mounted to said base;

armature means movably mounted on said base, said armature means being attracted to said electromagnet upon energization of said electromagnet;

stationary contact means mounted to said base;

movable contact means mounted to said armature means, said movable contact means engaging said stationary contact means upon attraction of said armature means to said electromagnet and separating from said stationary contact means upon de-energization of said electromagnet; and an arc chute disposed adjacent said contact means, said arc chute comprising:

an insulating housing comprising a right-hand arc extinguishing chamber, a left-hand arc extinguishing chamber, and a center arc extinguishing chamber disposed in a side-by-side arrangement;

an inlet opening in said housing adjacent said contact means and common to each of said arc extinguishing chambers;

a first conductive arc runner connected to said stationary contact and extending through said inlet opening into one of said right-hand and said left-hand chambers along an end wall thereof contiguous with said inlet opening;

a first V-shaped conductor disposed in said one of said right-hand and said left-hand chambers and in said center chamber, said first V-shaped conductor having a base disposed in proximity to said inlet opening, a first leg disposed in said one of said chambers in divergent relation to said first conductive arc runner, and a second leg disposed in said center chamber substantially parallel to said first conductive arc runner;

a second conductive arc runner connected to said movable contact and extending through said inlet opening into the other of said right-hand and said left-hand chambers along an end wall thereof contiguous with said inlet opening; and a second V-shaped conductor disposed in said other of said right-hand and said left-hand chambers and in said center chamber, said second V-shaped conductor having a base disposed in proximity to said inlet opening, a first leg disposed in said other of said chambers in divergent relation to said second conductive arc runner, and a second leg disposed in said center chamber substantially parallel to said second conductive arc runner;

said second leg of said first V-shaped conductor and said second leg of said second V-shaped conductor being disposed in divergent relation to each other in said center chamber.

10. Direct current switching apparatus comprising:

an insulating base;

an electromagnet mounted to said base;

armature means movably mounted on said base, said armature means being attracted to said electromagnet upon energization of said electromagnet;

stationary contact means mounted to said base;

movable contact means mounted to said armature means, said movable contact means engaging said stationary contact means upon attraction of said armature means to said electromagnet and separating from said stationary contact means upon de-energization of said electromagnet; and an arc chute disposed adjacent said contact means, said arc chute comprising:

an insulating housing comprising first and second arc extinguishing chambers disposed side-by-side;

an inlet opening in said housing adjacent said contact means, said inlet opening being common to both said chambers;

a pair of conductive arc runners connected to said stationary contact means and said movable contact means, respectively, said arc runners extending through said inlet opening into one of said first and second chambers and along end walls thereof contiguous with said inlet opening;

an insulating barrier dividing said one of said first and second chambers into two sub-chambers;

an elongated U-shaped conductor having a widened base portion disposed in said inlet opening in both said chambers, said U-shaped conductor having leg portions disposed in said other of said chambers dividing said other of said chambers into two sub-chambers;

a first V-shaped conductor disposed in a corresponding pair of sub-chambers of said first and second arc extinguishing chambers, said first V-shaped conductor having a base portion in said inlet opening extending across both said first and second chambers, a first leg disposed in said one of said chambers substantially along said insulating barrier divergent to one of said pair of conductive arc runners, and a second leg disposed in said other of said chambers divergent to an adjacent leg of said U-shaped conductor; and a second V-shaped conductor disposed in another corresponding pair of sub-chambers of said first and second arc extinguishing chambers, said second V-shaped conductor having a base portion in said inlet opening extending across both said first and second chambers, a first leg disposed in one of said chambers substantially along said insulating barrier divergent to the other of said pair of conductive arc runners, and a second leg disposed in said other of said chambers divergent to an adjacent leg of said U-shaped conductor.

11. Direct current switching apparatus comprising:

an insulating base;

an electromagnet mounted to said base;

armature means movably mounted on said base, said armature means being attracted to said electromagnet upon energization of said electromagnet;

stationary contact means mounted to said base;

movable contact means mounted to said armature means, said movable contact means engaging said stationary contact means upon attraction of said armature means to said electromagnet and separating from said stationary contact means upon de-energization of said electromagnet; and an arc chute disposed adjacent said contact means, said arc chute comprising:

an insulating housing comprising first and second arc extinguishing chambers disposed side-by-side;

an inlet opening in said housing adjacent said contact means, said inlet opening being common to both said chambers;

an insulating barrier in said first and second chambers extending radially from said inlet opening, dividing each of said first and second chambers into two sub-chambers, respectively;

an elongated U-shaped conductor having a base portion disposed in said inlet opening and extending across both said first and second chambers, said U-shaped conductor having leg portions offset from each other, one leg portion extending into said first arc extinguishing chamber substantially along said insulating barrier, and another leg portion extending into said second arc extinguishing chamber along said insulating barrier;

a first conductive arc runner connected to said stationary contact and extending through said inlet opening into said second arc extinguishing chamber along a wall thereof contiguous with said inlet opening;

a second conductive arc runner connected to said movable contact and extending through said inlet opening into said first arc extinguishing chamber along a wall thereof contiguous with said inlet opening;

a first V-shaped conductor disposed in a corresponding pair of sub-chambers of said first and second arc extinguishing chambers, said first V-shaped conductor having a base portion in said inlet opening extending across both said first and second chambers, a first leg disposed in said second chamber substantially along said insulating barrier divergent with said first conductive arc runner, and a second leg disposed in said first chamber divergent to said one leg of said U-shaped conductor; and a second V-shaped conductor disposed in a corresponding pair of sub-chambers of said first and second arc extinguishing chambers, said second V-shaped conductor having a base portion in said inlet opening extending across both said first and second chambers, a first leg disposed in said first chamber substantially along said insulating barrier divergent with said second conductive arc runner, and a second leg disposed in said second chamber divergent to said another leg of said U-shaped conductor.

* * * * *